United States Patent [19]

Sarcona

[11] Patent Number: 4,796,442

[45] Date of Patent: Jan. 10, 1989

[54] ITEM OF JEWELRY INCLUDING A GEM SLIDABLE WITHIN A GEM INSERT

[75] Inventor: Anthony O. Sarcona, Staten Island, N.Y.

[73] Assignee: Sarcona Bros., New York, N.Y.

[21] Appl. No.: 937,851

[22] Filed: Dec. 4, 1986

[51] Int. Cl.[4] ..... A44C 17/02

[52] U.S. Cl. ..... 63/26; 63/28; 63/29.1; 63/31; 63/15; 29/10; 29/160.6

[58] Field of Search ..... 29/10, 160.6; 63/26, 63/29 R, 30, 31, 15, 15.7, 28

[56] References Cited

U.S. PATENT DOCUMENTS

| | | | |
|---|---|---|---|
| 1,307,398 | 6/1919 | Grossman | 63/29 |
| 1,740,060 | 7/1927 | Baum | 63/29 R |
| 2,796,650 | 6/1957 | Van Buren, Jr. | 63/29 R |
| 4,187,697 | 2/1980 | Castelo | 63/31 |
| 4,237,702 | 12/1980 | Caverly | 63/31 |
| 4,294,084 | 10/1981 | Lampert | 63/31 |

FOREIGN PATENT DOCUMENTS

| | | | |
|---|---|---|---|
| 2344245 | 10/1977 | France | 63/31 |
| 2376638 | 9/1978 | France | 63/31 |

*Primary Examiner*—P. W. Echols
*Attorney, Agent, or Firm*—Paul J. Sutton

[57] ABSTRACT

A removable holding ring on an item of jewelry holds a replaceable insert which has a groove included in its top adapted for slidably retaining a replaceable ornament with a portion exposed for public view. Resilient support between the insert and the item permits full seating of the holding ring on the item. The holding ring is attached on the item by a resilient extension with dimples to engage a reduced diameter section with grooves on the item.

2 Claims, 2 Drawing Sheets

ITEM OF JEWELRY INCLUDING A GEM SLIDABLE WITHIN A GEM INSERT

BACKGROUND OF THE INVENTION

1. Field of the Invention:

The present invention relates to jewelry in general, and more particularly to movable and interchangeable gem settings.

2. Background of the Invention:

It is most desirable in jewelry setting to attract the eye of public view toward the ornament, usually a gemstone, around which the piece is designed. It is also desirable to select jewelry which matches clothing or which befits an occasion.

In order to meet the above objectives, both user and seller of jewelry must maintain a costly, relatively large variety of pieces on hand. The cost is further increased if matching pieces are desired, say ring and pendant or bracelet, and the gemstone is of the precious or semiprecious type.

The present invention is provided to overcome those obstacles.

SUMMARY OF THE INVENTION

It is one object of the invention to provide an insert system for an item of jewelry which draws the public eye toward the ornament.

It is another object of the invention to provide an insert system for an item of jewelry which provides easy changing of the ornament.

It is another object of the invention to provide an insert system which also provides easy changing of the field surrounding the ornament.

It is another object of the invention to provide an insert system which provides for interchangeable display in contrast between the available wide variety of precious and semiprecious stones.

It is still another object of the invention to provide for mounting the ornament with a portion above the item for viewing it from an oblique angle, while affording protection against damage from striking with foreign objects.

Other objects and advantages will become readily apparent from the ensuing description and drawings.

Briefly, in accordance with the present invention, an item of jewelry with a removable holding ring is provided. The ring holds a replaceable insert on the item. The insert has a groove included in its top, adapted for slidably retaining a replaceable ornament with a portion of the ornament exposed for public view. When attached to the item, the holding ring prevents the ornament from exiting the open end of the groove. The insert and/or the ornament may be selected from the wide variety of presently available precious or semiprecious stones.

In one embodiment resilient means are included in a space provided between the insert and the item to permit the holding ring to fully seat when it is attached to the item. In another embodiment, the insert body is fully retained within a portion of the holding ring which is removably attached to the item. Im another embodiment the item is formed for permanently retaining the insert with its sliding ornament. The ornament may include a setting for a jewel to hold it in special visual perspective. Means for attaching the holding ring to the item include a resilient extension with dimples to engage a reduced diameter section with grooves on the item, and a threaded pedestal with corresponding threads on the lower inner surface of the holding ring.

DETAILED DESCRIPTION OF THE INVENTION

Figure 1:
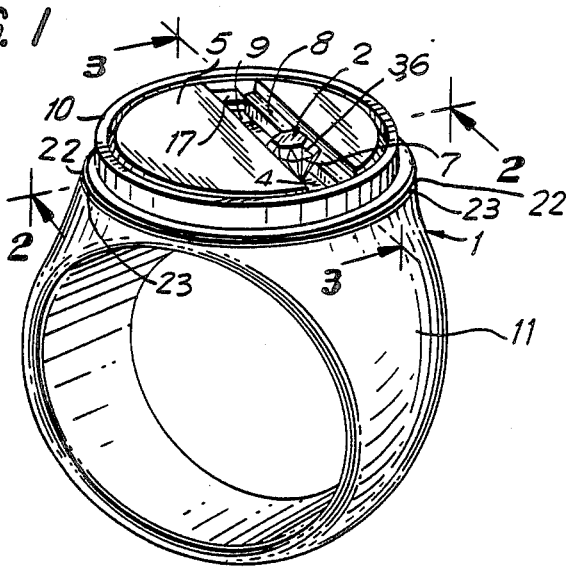
FIG. 1 is a perspective view of a piece of jewelry employing the invention.

FIG. 1 shows a typical item of jewelry 1 which may use the present invention. Although illustrated for example as a ring, it may be a bracelet, broach or similar item of adornment. The piece is usually designed around the ornament 2 to draw attention to it and to put it in its best perspective for public view. The ornament may be a precious or semiprecious gemstone 3, a pearl or some other item that is considered to be of value or beauty. For that purpose, the present invention includes groove 4 in insert 5 which retains cut diamond 6 largest diameter portion 7 within its opposed angular tracks 8 as may be seen in FIG. 2. Although the diamond cannot escape the groove, it can exit the groove from the open end 9. This is prevented, however, by holding ring 10 which is removably attached to this item of jewelry 11.

Insert 5 may comprise a precious or semiprecious gem stone or otherwise constructed from a material that is considered to be of value or beauty.

Several modes of attachment are within the contemplation of this invention, including extension 12 of the holding ring which is resilient and is forced down over a reduced diameter section 13 of item 11. Extension 12 abuts with the item at its end and includes a pair of inwardly directed dimples 14 which mate with indentations 15 in item 11. The groove and dimple arrangement is preferably used when it is desired that the insert maintains a certain orientation with respect to item 11 for aesthetic reasons.

The insert and holding ring retain orientation with respect to one another when they are oblong in shape. When they are round, a keyed portion 17 extends from the inner diameter of ring 10 for extending into groove 4 sufficiently to prevent rotation of one with respect to the other.

Alternatively, a groove (not shown) for receiving the dimples may be included around reduced diameter section 13 so that the holding ring may be attached without attention to position of groove 4 with respect to the rest of the piece.

Figure 4:
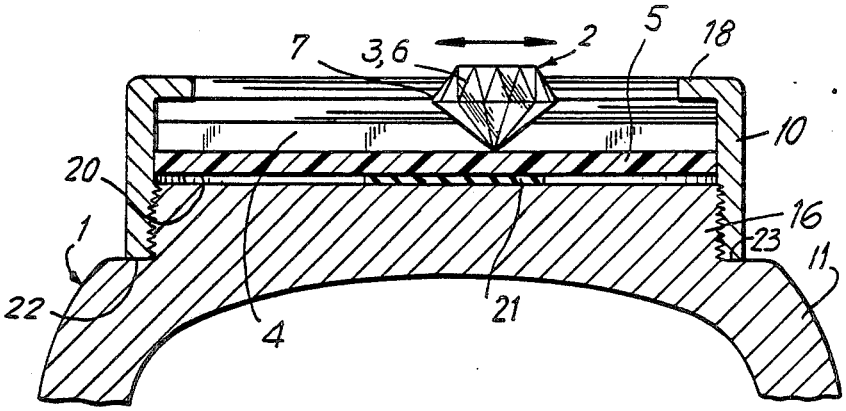
FIG. 4 is a sectional view showing an embodiment of the invention including threaded removable attachment.

Attachment may be made by means of a threaded pedestal 16 as shown in FIG. 4, where the threads provide the means for temporarily securing the attachment, or some other removable attachment may be used.

It is also within the contemplation of the invention, that holding ring 10 be formed as part of item 11.

Figure 2:
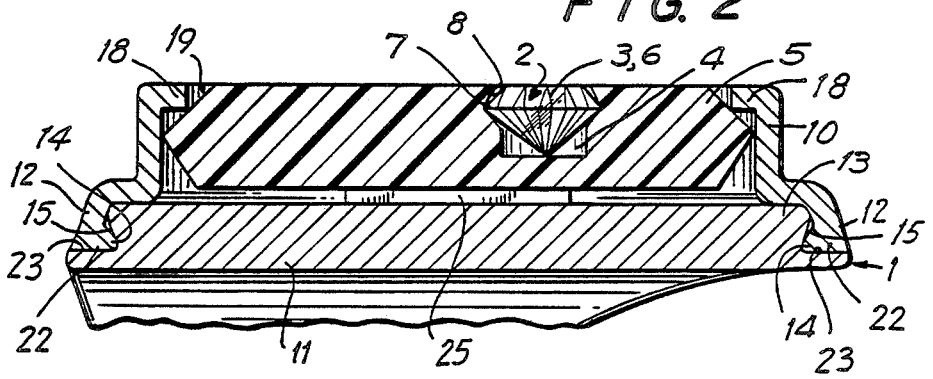
FIG. 2 is a sectional view taken along lines 2—2 of FIG. 1.

Referring to FIG. 2, holding ring 10 includes lip portion 18 for holding the insert on item 11 by engaging it near its top by tapered edge 19. Lip portion 18 may also comprise flanges or some other extended portion shape for similarly engaging the insert near its top.

In the embodiment shown in FIG. 4, holding ring 10 is designed to allow for space between the bottom 20 of insert 5 and the portion of item 11 that is below it. Resilient spacer 21, included in the space, urges the insert into contact with lip portion 18. Resilient spacer 21 permits the holding ring to be fully seated on item 11, with the end 22 of holding ring extension 12 fully abutted with shoulder 23 on item 11. This is desired for aesthetic reasons.

Resilient spacer 21 also provides a unique and interesting tactile feature whereby a viewer touching the insert to move the diamond in the groove will meet with a yielding insert. Additionally, the arrangement provides protection for a gemstome which is mounted to extend above the insert, whereby it is forced down with the insert, into the protection of the holding ring when inadvertently encountering an obstacle.

Figure 5:
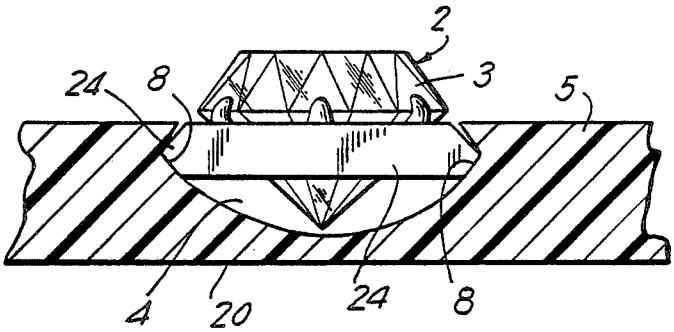
FIG. 5 is a sectional view of a portion of the invention showing an insert and ornament.

In FIG. 5, a mounting arrangement is seen in which the gemstome 3 such as a diamond, desired to be viewed from an oblique perspective, is mounted in ornamental setting 24 so that the set of stone and setting forms ornament 2 which is slidably retained in groove 4's angular tracks 8, with the upper portion of the stone extending above the insert for catching the eye.

Figure 3:
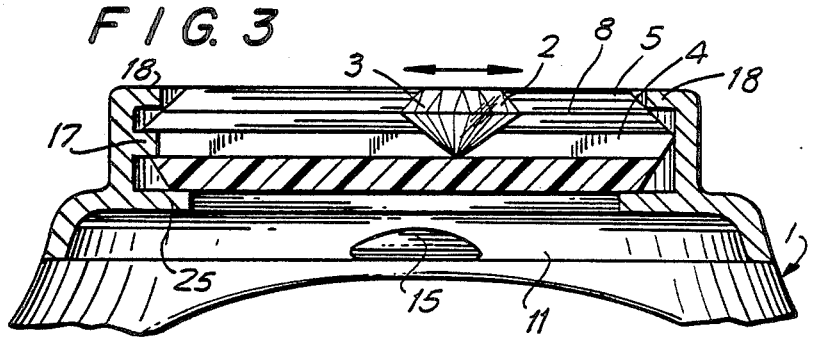
FIG. 3 is a sectional view taken along lines 3—3 of FIG. 1.

Holding ring 10 in the embodiment shown in FIG. 3 includes lip portion 25 for engaging the insert at its bottom 20 for holding it within the holding ring. Lip portion 25 may hold the insert anywhere near its bottom as long as it cooperates with lip portion 18 for holding the insert. A similar arrangement may be seen in FIG. 4 where holding ring 10 encloses the insert but for the viewing top portion.

While several embodiments of the invention have been described and shown, it is obvious that various modifications and changes can be made without departing from the scope of the invention.

I claim:

1. An item of jewelry comprising:

a first gem having a top, and a bottom, a second gem, said first gem including in its top, a groove that is longer than said second gem for retaining said second gem securely but slidably within the groove, with portions of the second gem that are above and below the groove exposed for public view and, said groove traversing the first gem and being open at both ends for slidably admitting the second gem, a housing, removably covering both ends of the groove for retaining the second gem within the groove yet allowing it to slide within the groove, said housing including means for holding the first gem on the item.

2. The invention as described in claim 1, further comprising:

said means for holding, including a removable ring which engages the top of the first gem, and encircles and grips a portion of the item.

* * * * *